United States Patent [19]

Matson

[11] 4,433,524

[45] Feb. 28, 1984

[54] METHOD AND APPARATUS FOR SLIP-CONNECTOR STRUCTURAL JOINT

[75] Inventor: John S. Matson, Racine, Wis.

[73] Assignee: Nostam, Inc., Racine, Wis.

[21] Appl. No.: 275,295

[22] Filed: Jun. 19, 1981

[51] Int. Cl.[3] ..... E04B 1/18

[52] U.S. Cl. ..... 52/665; 52/488; 52/713; 52/741; 403/387

[58] Field of Search ..... 52/235, 350, 357, 359, 52/488, 508, 665, 713, 714, 741, 712, 715; 403/397, 387

[56] References Cited

U.S. PATENT DOCUMENTS

| | | | |
|---|---|---|---|
| 1,452,599 | 4/1923 | Hames | 52/90 X |
| 1,824,631 | 9/1931 | Saxe . | |
| 1,879,459 | 9/1932 | Pelton . | |
| 1,984,028 | 12/1934 | MacLeod . | |
| 2,907,199 | 10/1959 | Johnson | 52/359 |
| 3,238,684 | 3/1966 | Wood . | |
| 3,353,312 | 11/1967 | Storch | 52/508 X |
| 3,410,588 | 11/1968 | Frye et al. | 52/665 X |
| 4,121,391 | 10/1978 | Schroeder | 52/235 |
| 4,194,333 | 3/1980 | Paton et al. | 52/235 |

FOREIGN PATENT DOCUMENTS

| | | | |
|---|---|---|---|
| 1307610 | 9/1962 | France | 52/488 |
| 501984 | 3/1939 | United Kingdom | 52/715 |

OTHER PUBLICATIONS

Publication by Inryco, "Vertical Slide Clip."

*Primary Examiner*—Alfred C. Perham
*Attorney, Agent, or Firm*—Arthur J. Hansmann

[57] ABSTRACT

Method and apparatus for slip-connector structural joint which joins a horizontal beam and a vertical stud of a structure, such as a commercial building. A plate spans the beam and stud and is attached to the beam and has an opening therein which snugly receives an edge of the stud which is generally channel-shaped, and the connection with the stud permits a vertical slip joint. Thus, the stud is retained against lateral movement while vertical movement is available to present the desired slip joint.

5 Claims, 8 Drawing Figures

METHOD AND APPARATUS FOR SLIP-CONNECTOR STRUCTURAL JOINT

This invention relates to a method and apparatus for providing a slip-connector structural joint such as the joint required in the framing of a commercial building.

BACKGROUND OF THE INVENTION

Commercial buildings are commonly made with horizontal beams and vertical studs which are connected together and which permit the stud to have vertical movement. That is, a connector extends between the beam and the stud and is a slip type connector which provides for the desired vertical movement relative between the beam and the stud. The prior art is already aware of connectors for building framing or structures and which permit vertical movement between the beam and the vertical stud. One example of the prior art is found in the type of vertical slide clip utilized by a corporation named Inryco, Inc., and a print filed with the present document shows that prior art clip which is angled and has a slot therein. Also, U.S. Pat. Nos. 1,452,559 and 1,824,631 and 1,879,459 and 1,984,028 and 3,238,684 show connectors or joints relative to structural pieces.

However, the prior art is different from the present invention in that the present invention relates to a slip-connector which snugly receives the edge of the vertical stud which is channel-shaped and which therefore restricts the stud but permits the relative vertical movement between the beam and the stud. An important feature is that the present invention provides for a plate which forms the joint between the beam and the stud and which is arranged so that the plate can be readily and easily welded or otherwise connected to the beam, and the connection can be securely and easily made on the job site.

Still further, the present invention differs from the prior art in that the connector forming the joint of the present invention can be installed at the desired locations between the horizontally extending beams and when the beams are already in place, and therefore there is no requirement for sliding a connector from the end of the stud and down to the particular beam in order to have one connector at each beam. That is, the connector of the present invention can be installed between every two beams and after the beams are in position, rather than sliding the connector down the stud in sequence with the installation of each and every beam. In that manner, it is always possible to properly position the connector, and the likely error of omitting the positioning of one connector between every two beams is avoided.

Still further, the present invention provides a method and apparatus for a slip-connector type of joint for a structure having a beam and a vertical stud adjacent thereto wherein the joint provides a secure connection and properly laterally restricts the stud while permitting the vertical slip connection between the beam and the stud, and also the joint of this invention is easily and accurately installed on the job site. With regard to installation, the present invention provides the advantage of avoiding the requirement for any welding on the confined vertical stud, and the only welding or like attachment can be performed with respect to the accessible horizontal beam. The present invention also distinguishes over the prior art in that it provides a stronger joint.

DETAILED DESCRIPTION OF THE METHOD AND PREFERRED EMBODIMENTS

The drawings and the following description are primarily referring to the apparatus of the joint of this invention, however, it will be understood that the methods are also described with reference to the drawings and the embodiments of the apparatus.

Figure 1:
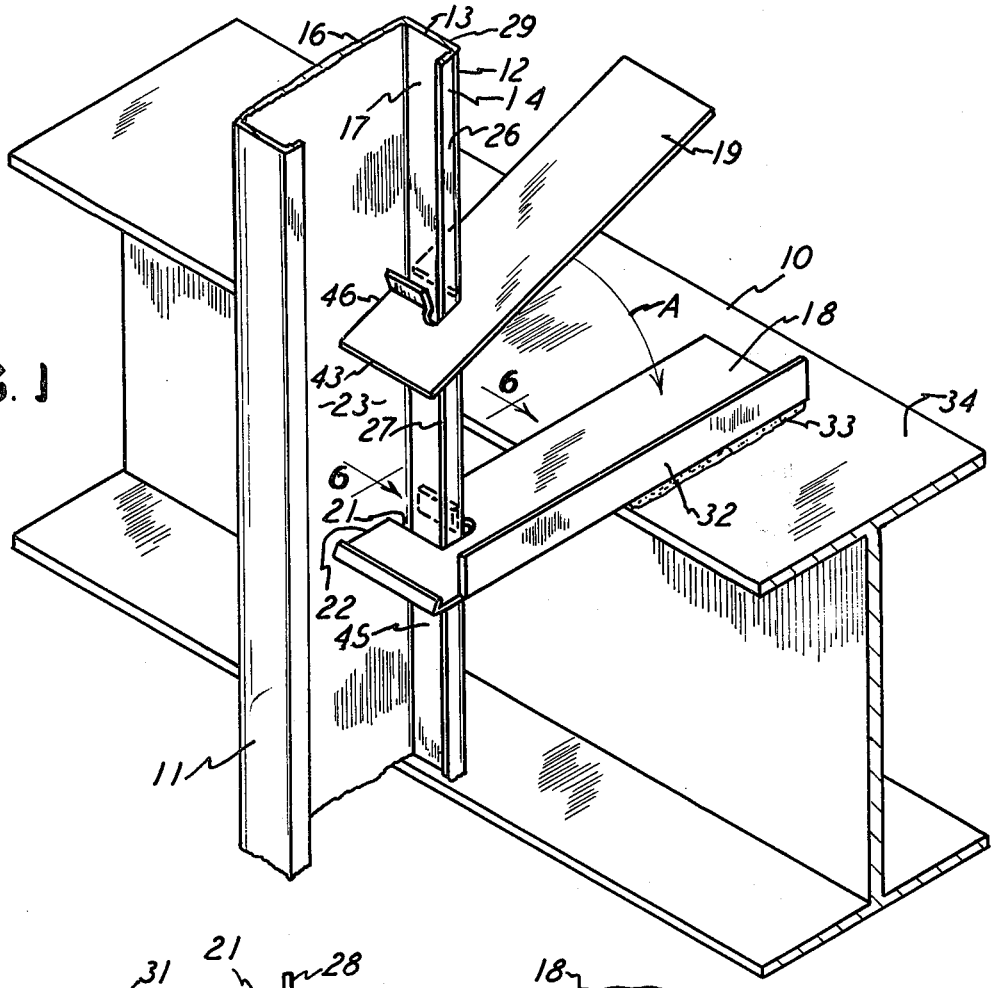
FIG. 1 is a perspective view of one embodiment of this invention shown being assembled with the stud and beam.
Figure 2:
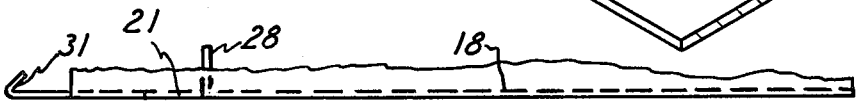
FIGS. 2 and 3 are, respectively, side and top views of the lower plate shown in FIG. 1.
Figure 3:
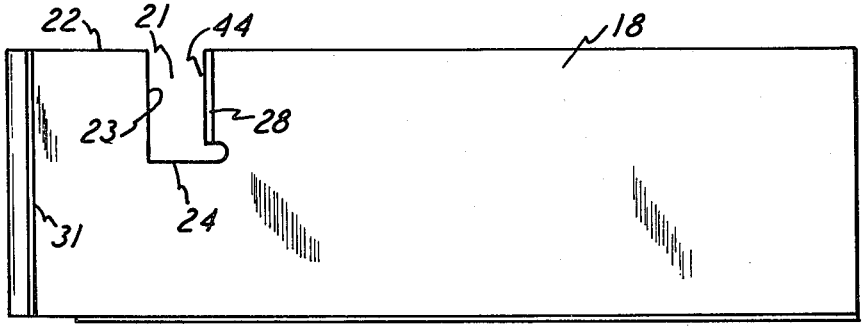
Figure 4:
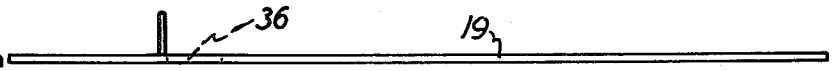
FIGS. 4 and 5 are, respectively, side and top views of the upper plate shown in FIG. 1.
Figure 5:
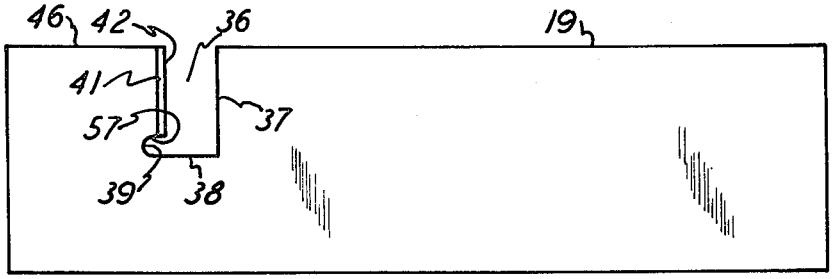
Figure 7:
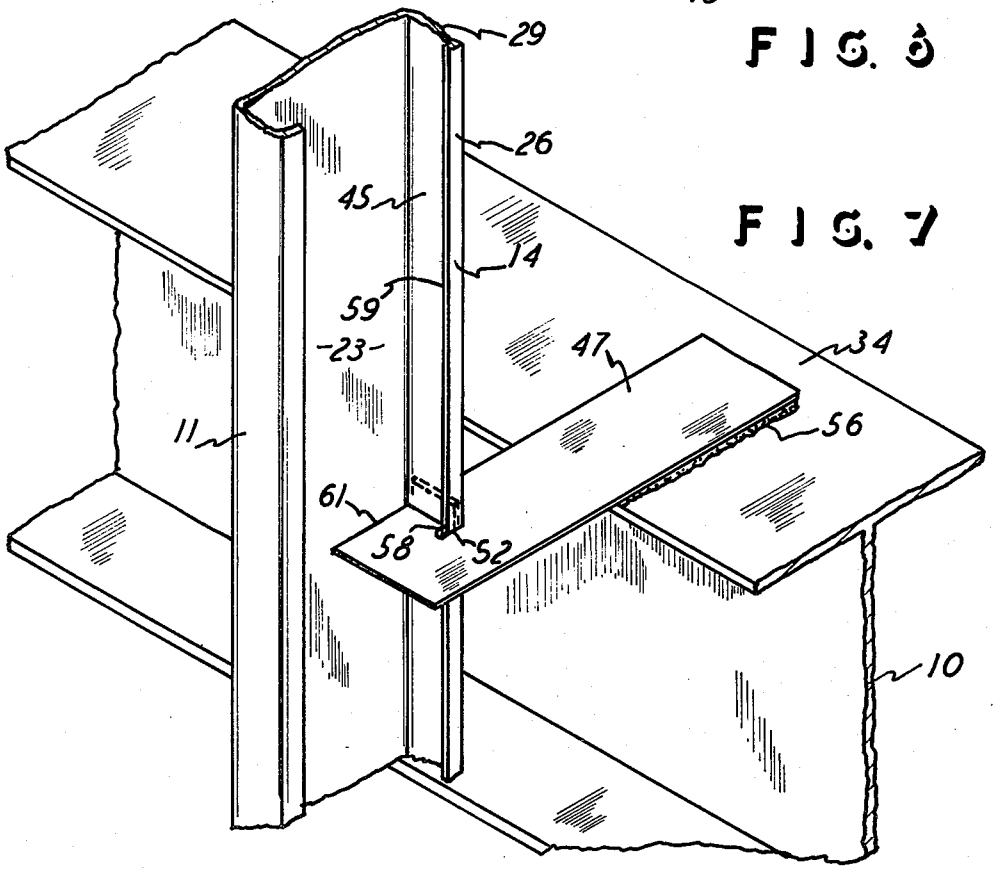
FIG. 7 is a perspective view similar to FIG. 1 but showing another form of this invention.

FIGS. 1 and 7 show a horizontal disposed I-beam 10 and a vertically disposed stud 11, and these are both of steel material and are fragmentarily shown as portions of a commercial building structure of common use today. The stud 11 is C-shaped, and it has a channel-shaped side portion designated 12 which includes the two angled sides 13 and 14 extending off the back portion 16. Of course that shape of stud is commonly known and employed today. The portions 13 and 14 are at right angles to each other and the portion 13 is of a greater width than the portion 14 which can also be termed the terminal portion or inturned end lip of the stud 11. Thus, the side portion 12 which is composed of the three sided pieces 13, 14, and 16 present a hollow interior designated 17.

FIGS. 1 through 6 show one embodiment of both the method and apparatus of this invention, and it will here be seen that two plates 18 and 19 are utilized. The plate 18 has an opening 21 which extends into a side edge 22 of the plate 18, as clearly shown in FIG. 3. The plates 18 and 19 are of steel material so that they can be welded to the beam 10 and to each other. The depth of the opening 21 extending along the line designated 23 is of the width of the stud portion 13. Thus, in the FIG. 1 assembled position of the plate 18 with the stud 11, the plate edge designated 24, which is the base line for the opening 21, can abut the stud outside surface 26 while the plate edge 22 is adjacent the stud interwall designated 23. That is to say, the opening 21 corresponds to the configuration of the stud side portion 12 in that the opening 21 snugly receives the side portion 12 in the depth relationship mentioned and also in the fact that the stud edge 27 can abut the plate edge 23, and the plate 18 has an upturned flange 28 which can abut the outside surface 29 on the stud side portion 12. Therefore, the plate 18 can be moved horizontally relative to the vertical stud 11 and can be positioned in the position shown in FIG. 1 to where the plate opening 21 snugly receives the stud side portion 12 in the manner described.

It will also be seen that the plate 18 has an upturned end 31 which serves as a guide for the plate 19 in the final assembled position and as described later, and the plate 18 also may have an upturned side 32 for added strength and rigidity in the function of the plate 18 forming the joint and spanning between the beam 10 and stud 11. Thus the plate 18 is suitably attached to the beam 10, such as by welding at 33, for instance. To accomplish that, the beam 10 has an upwardly and smoothly disposed surface 34 on which the plate 18 can rest and which the plate 18 can therefore be easily and readily welded to the beam 10 on the job site as the welder has ready access to the beam exposed under surface 34 as well as to the exposed plate 18.

Next, the plate 19 can also be hooked onto the stud side portion 12 since the plate 19 has a side opening 36 which is also of the size and configuration of the stud side portion 12. That is, the opening 36 is defined by the edges 37 and 38, and there is a notch 39 which snugly receives the lip portion 14 of the stud 11 and surrounds that lip 14. Also, an upturned flange 41 presents a side 42 defining the opening 36. Therefore, the dimension from the edge 37 and side 42 is adequate to permit the plate 19 to be slid laterally over the lip 14 and onto the stud 11, such as in the position shown in FIG. 1. In final assembled position, such as shown in FIG. 6, the wall 42 can abut the stud surface 45 and thus restrict the movement of the stud toward the surface or wall 42 when the plate 19 is in its fixed position as described hereinafter.

Figure 6:
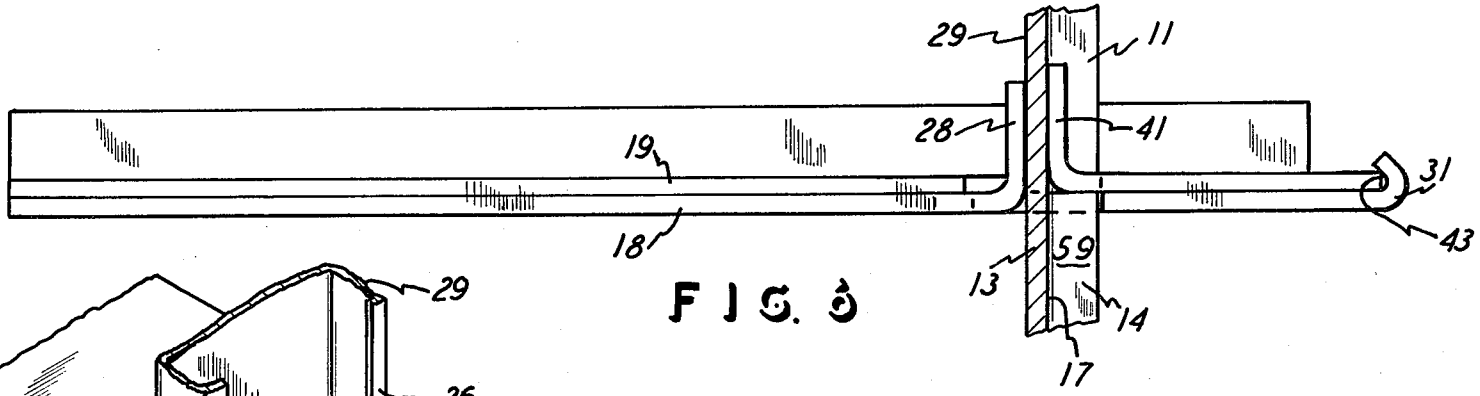
FIG. 6 is an enlarged sectional view taken along the lines 6—6 of FIG. 1.

The edge 43 of the plate 19 fits under the upturned lip 31 of the plate 18, as shown in FIG. 6, and is secure and held therein, and that locates the wall 42 against the stud surface 45, as mentioned, when the plate 18 is positioned to present its wall 44 against the stud outside surface 29, also as shown in FIG. 6.

Thus, the depth of the two openings 21 and 36 is the same, and therefore they both extend into contact with the surfaces 26 and 23 by their respective edges 24 and 22 and 38 and 46. Also, the openings 21 and 36 overlap but are slightly offset so that their respective surfaces 44 and 42 are in contact with the stud side portion walls 29 and 45. That is all in addition to the portion 39 of the opening 36 hooking around the stud edge 27 to provide further lateral restriction to the stud 11 but while permitting the relative vertical motion between the beam 10 and stud 11, as mentioned herein. Thus, the depth of the notch 39 is the same as the width of the stud portion 14, to achieve the snug relationship of the notch 39 receiving that lip portion 14.

Of course in the final assembly, the plate 19 is lowered from its FIG. 1 position and down onto the plate 18, as shown by the arrow designated A in FIG. 1, and then the plate 19 is welded to either or both of the plate 18 and beam 10.

In this arrangement, the plates 18 and 19 can be placed into position between any two horizontally extending beams 10, since the plates need not be slid along the stud 11 before installing beam 10 in order to position the plates on top of the beam 10. The plate portions 31 and 43 serve as stops or alignment guides, and the two plates are also positioned on the stud portion 12 to be bottomed thereon relative to the plate edges 24 and 38, all to have the plates 18 and 19 in vertical sliding relationship with the stud 11 while restricting the stud in the horizontal or lateral relationship which is in the plane of the plates 18 and 19 since the stud channel portion 12 is trapped by the overlapping plates with the offset openings 21 and 36.

Figure 8:
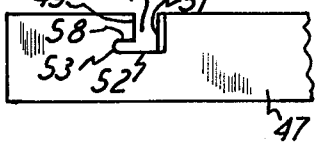
FIG. 8 is a top plan view, on reduced scale, of a fragment of the plate shown in FIG. 7.

FIGS. 7 and 8 show another method and embodiment of the apparatus, and here only a single plate 47 is utilized and it has an edge opening 48 which is of a rectangular configuration defined by the walls 49 and 51 and the bottom edge 52 and the notch 53. Thus, the plate 47 in this instance is slid over the end of the stud 11 and has its surfaces 51, 52, and 49, in contact with the respective stud surfaces 29, 26, and 45. Also, the notch 53 snugly receives the stud lip 14. Therefore, the stud 11 is again restrained laterally but has vertical slip action, and the plate 47 can be placed into its nested position with the stud 11 by sliding it down on the stud 11 as shown in FIG. 7. Finally, the plate 47 can be attached to the beam top surface 34 by the welding 56 or the like.

In both embodiments of the methods and apparatus, the plates snugly retain the stud 11, and the attachment of the plates to the beam 10 is easily accomplished since the plates and beam are well exposed to the welder or whoever is making the attachment, and one need not work at the interior of the channel of the stud 11, for instance, to make a weldment.

In both embodiments, the respective notches 39 and 53 have edges 57 and 58 which are positioned adjacent the stud innersurface 59 for restricting the stud movement in the direction away from the base of the respective openings 36 and 48. Therefore, the stud is restricted in all four directions of lateral movement and can have only a vertical movement relative to the beam 10, as desired. Also, the plate 47 has an edge 61 which is in abutment with the stud surface 23 for restricting movement of the stud toward the edge 61 and thus the stud is completely trapped in the horizontal direction by means of the plate 47.

Also, before the welding is applied, the plates 18 and 47 can be adjusted relative to the beam 10, and thus the stud 11 can be adjusted in the horizontal direction.

What is claimed is:

1. A slip-connector for a structural joint between a steel beam and a C-shaped steel stud having a channel-shaped side portion, comprising a first steel plate having an opening in the edge thereof receiving the stud side portion to restrict lateral movement of the stud while allowing longitudinal movement of the stud, said first plate having a portion projecting from the stud and onto the beam and with the projecting portion connected to the beam, a second steel plate having an opening in the edge thereof receiving the stud side portion and being offset with said first plate opening for further restricting lateral movement of the stud and with said second plate being connected to said first plate.

2. The slip-connector for a structural joint between a steel beam and a C-shaped steel stud having a channel-shaped side portion as claimed in claim 1, wherein said opening of one of said plates is the shape of the side portion for snug nesting therewith.

3. The slip-connector for a structural joint between a steel beam and a C-shaped steel stud having a channel-shaped side portion as claimed in claim 1 or 2, wherein one of said plates includes a positioning guide for matching said plates, and thereby their said openings, to each other.

4. The slip-connector for a structural joint between a steel beam and a C-shaped steel stud having a channel-shaped side portion as claimed in claim 1 or 2, wherein the stud side portion has two portions at right angles to each other forming the channel-shape, and one of said plate openings includes a notch which receives the terminal one of the two right angle portions and thereby snugly encloses the two right angle portions.

5. A method of slip-connecting a steel beam and a C-shaped steel stud having a channel-shaped side portion, comprising the steps of providing in the edge of a first steel plate an opening for receiving the side portion of the stud for nesting with the stud and for restricting lateral movement of the stud, placing said plate onto the stud side portion in the nested position therewith and having said plate project laterally of the stud and sliding said plate along the stud and into contact with the beam, welding said plate to the beam, providing in the edge of a second steel plate an opening for receiving the side portion of the stud and overlapping with said opening in said first plate for snugly nesting the two said plates with said stud, and placing said second plate onto said first plate with said openings nesting with the side portion, and welding said second plate onto said first plate.

* * * * *